US010023826B2

(12) United States Patent
De Poortere et al.

(10) Patent No.: US 10,023,826 B2
(45) Date of Patent: Jul. 17, 2018

(54) SOLUBLE UNIT DOSE COMPRISING A COMPOSITION

(71) Applicant: The Procter & Gamble Company, Cincinnati, OH (US)

(72) Inventors: Johan Maurice Theo De Poortere, Merelbeke (BE); Jef Annie Alfons Maes, Sint-Niklaas (BE); Jean-Francois Bodet, Waterloo (BE); Bruno Jean-Pierre Matthys, Brussels (BE); Alice Michele Boutoille, Brussels (BE); Lucia FernandezMartinez, Brussels (BE); Rebecca Ann Langevin, Norwood, OH (US); Bernard William Kluesener, Harrison, OH (US); Rajan Keshav Panandiker, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/819,466

(22) Filed: Aug. 6, 2015

(65) Prior Publication Data

US 2016/0040101 A1 Feb. 11, 2016

Related U.S. Application Data

(60) Provisional application No. 62/034,184, filed on Aug. 7, 2014.

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/00*** | (2006.01) |
| ***C11D 1/22*** | (2006.01) |
| ***C11D 3/20*** | (2006.01) |
| ***C11D 3/37*** | (2006.01) |
| ***C11D 17/04*** | (2006.01) |
| ***C11D 10/04*** | (2006.01) |
| *C11D 1/29* | (2006.01) |
| *C11D 1/72* | (2006.01) |

(52) U.S. Cl.

CPC ..... *C11D 3/0026* (2013.01); *C11D 1/22* (2013.01); *C11D 1/66* (2013.01); *C11D 1/83* (2013.01); *C11D 3/2075* (2013.01); *C11D 3/373* (2013.01); *C11D 10/04* (2013.01); *C11D 17/042* (2013.01); *C11D 1/29* (2013.01); *C11D 1/72* (2013.01)

(58) Field of Classification Search

CPC .... C11D 1/02; C11D 1/66; C11D 1/83; C11D 3/162; C11D 3/373; C11D 17/042

See application file for complete search history.

(56) References Cited

U.S. PATENT DOCUMENTS

| | | | | |
|---|---|---|---|---|
| 6,949,498 | B2 | 9/2005 | Murphy et al. | |
| 7,528,099 | B2 | 5/2009 | Wahl et al. | |
| 7,563,757 | B2 | 7/2009 | Kouvroukoglou et al. | |
| 8,492,325 | B2 | 7/2013 | Sadlowski et al. | |
| 8,889,610 | B2 | 11/2014 | Labeque et al. | |
| 8,895,493 | B2 | 11/2014 | Labeque et al. | |
| 2002/0137562 | A1 | 9/2002 | Malone | |
| 2004/0142840 | A1 | 7/2004 | De Buzzaccarini et al. | |
| 2008/0234165 | A1 | 9/2008 | Panandiker et al. | |
| 2008/0261850 | A1 | 10/2008 | Briggs et al. | |
| 2010/0313360 | A1 | 12/2010 | Menting et al. | |
| 2011/0152159 | A1 | 6/2011 | Labeque | |
| 2011/0152163 | A1 | 6/2011 | Labeque et al. | |
| 2011/0209291 | A1* | 9/2011 | Sadlowski | C11D 1/29 8/137 |
| 2011/0252576 | A1* | 10/2011 | Boutique | C11D 1/83 8/137 |
| 2011/0319310 | A1 | 12/2011 | Labeque et al. | |
| 2012/0294969 | A1 | 11/2012 | Koch et al. | |

FOREIGN PATENT DOCUMENTS

| | | |
|---|---|---|
| CA | 2 589 983 C | 6/2012 |
| EP | 0 253 5662 A2 | 1/1988 |

OTHER PUBLICATIONS

PCT Search Report for International Application No. PCT/US2015/043988, dated Nov. 5, 2015, containing 12 pages.

U.S. Appl. No. 14/834,463, filed Aug. 25, 2015, Rajan Keshav Panandiker.

U.S. Appl. No. 14/834,464, filed Aug. 25, 2015, Renae Dianna Fossum.

U.S. Appl. No. 14/834,468, filed Aug. 25, 2015, Rajan Keshav Panandiker.

U.S. Appl. No. 14/819,461, filed Aug. 6, 2015, Jef Annie Alfons Maes.

U.S. Appl. No. 14/819,462, filed Aug. 6, 2015, Jef Annie Alfons Maes.

U.S. Appl. No. 14/819,463, filed Aug. 6, 2015, Karel Jozef Maria Depoot.

U.S. Appl. No. 14/819,465, filed Aug. 6, 2015, Karel Jozef Maria Depoot.

* cited by examiner

*Primary Examiner* — Brian P Mruk

(74) *Attorney, Agent, or Firm* — Lauren Christine Gonzalez; Gregory S. Darley-Emerson; Melissa G. Krasovec

(57) ABSTRACT

A water-soluble pouch including a water-soluble film and at least one compartment enclosed by the film, where the compartment includes a composition, and where the composition includes a siloxane-based polymer suds suppressor.

8 Claims, No Drawings

SOLUBLE UNIT DOSE COMPRISING A COMPOSITION

FIELD OF THE INVENTION

The instant application claims priority to Provisional Application Ser. No. 62/034,184, filed Aug. 7,2014.

BACKGROUND OF THE INVENTION

Water-soluble unitized dose pouch products have become popular in recent years. Such pouches comprise a water soluble film envelope which surrounds and encapsulates a detergent composition, such as a laundry detergent composition.

Often, water-soluble pouch laundry detergent compositions are formulated with anionic surfactants. These have a tendency to form foam during the wash process which can, if present in too high a quantity, can cause problems in automatic fabric washing machines. Foam generation is controlled in unitized dose pouch products by maintaining a relatively low anionic surfactant level and incorporating fatty acid.

However, such a formulation approach is not effective for greasy stain cleaning from fabrics. In order to overcome this negative, anionic levels need to be increased. However, this results in increased suds generation. Increase of fatty acid levels in order to compensate for the increase in anionic surfactant levels results in compositional instability which negatively impacts cleaning performance.

Therefore, there is a need in the art for a water-soluble unitized dose pouch product that provides improved greasy stain cleaning on fabrics, is compositionally stable, and does not have the drawback of excess foam generation.

SUMMARY OF THE INVENTION

The present disclosure relates to a water-soluble pouch comprising a water-soluble film and at least one compartment enclosed by the film, wherein the compartment comprises a composition, and wherein the composition comprises;

a. an anionic surfactant;
b. a non-ionic surfactant;
c. optionally a fatty acid;
d. a siloxane-based polymer suds suppressor;

wherein, the anionic surfactant is present at a concentration of greater than 5% by weight of the composition, the non-ionic surfactant is present at a concentration of 4% or less by weight of the composition and the fatty acid is present at a concentration of 4% or less by weight of the composition.

DETAILED DESCRIPTION OF THE INVENTION

It has been surprisingly found that the unitized dose pouch product of the present disclosure overcomes one or more of the problems described above. The pouch of the present disclosure comprises a laundry detergent composition wherein the levels of anionic surfactant, non-ionic surfactant and fatty acid are carefully balanced, and wherein the composition comprises a siloxane-based polymer suds suppressor.

The present disclosure relates to a water-soluble pouch comprising a water-soluble film and at least one compartment enclosed by the film, wherein the compartment comprises a composition, and wherein the composition comprises;

a. an anionic surfactant;
b. a non-ionic surfactant;
c. optionally a fatty acid;
d. a siloxane-based polymer suds suppressor;

wherein, the anionic surfactant is present at a concentration of greater than 5% by weight of the composition, the non-ionic surfactant is present at a concentration of 4% or less by weight of the composition and the fatty acid is present at a concentration of 4% or less by weight of the composition.

Water-soluble Pouch

The water-soluble pouch comprises a water-soluble film and at least one compartment enclosed by the film. The compartment comprises a composition. The composition may be a solid, liquid, gel, fluid, dispersion or a mixture thereof.

The water-soluble film is sealed such that the composition does not leak out of the compartment during storage. However, upon addition of the water-soluble pouch to water, the water-soluble film dissolves and releases the contents of the internal compartment into the wash liquor.

The water-soluble pouch can be of any form, shape and material which is suitable for holding the composition, i.e. without allowing the release of the composition, and any additional component, from the water-soluble pouch prior to contact of the water-soluble pouch with water. The exact execution will depend, for example, on the type and amount of the compositions in the water-soluble pouch, the number of water-soluble pouch to hold, protect and deliver or release the compositions or components.

The water-soluble pouch may optionally comprise additional compartments; said additional compartments may comprise an additional composition. Alternatively, any additional solid component may be suspended in a liquid-filled compartment. A multi-compartment water-soluble pouch form may be desirable for such reasons as: separating chemically incompatible ingredients; or where it is desirable for a portion of the ingredients to be released into the wash earlier or later. The water-soluble pouch may comprise at least one, or even at least two, or even at least three, or even at least four, or even at least five compartments. The multiple compartments may be arranged in any suitable orientation. For example they may be arranged in a superposed orientation, in which one compartment is positioned on top of another compartment. A superposed orientation may be one comprising three compartments, wherein two compartments are arranged side-by-side to one another, and wherein the side-by-side compartments are positioned on top of a third larger compartment. Alternatively, they may all be positioned in a side-by-side arrangement. In such an arrangement the compartments may be connected to one another and share a dividing wall, or may be substantially separated and simple held together by a connector or bridge. Alternatively, the compartments may be arranged in a 'tyre and rim' orientation, i.e. a first compartment is positioned next to a second compartment, but the first compartment at least partially surrounds the second compartment, but does not completely enclose the second compartment.

The water-soluble film is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as film material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the film material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred film materials are polymeric materials. The film material can be obtained, for example, by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material. Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310, films described in U.S. Pat. Nos. 6,166,117 and 6,787,512 and PVA films of corresponding solubility and deformability characteristics. Further preferred films are those describes in US2006/0213801, WO 2010/119022 and U.S. Pat. No. 6,787,512.

Preferred water soluble films are those resins comprising one or more PYA polymers, preferably said water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 cP (cP mean centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20 deg. C. All viscosities specified herein in cP should be understood to refer to the viscosity of 4% aqueous polyvinyl alcohol solution at 20 deg. C, unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt. % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt. % of the second PVA polymer.

When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

Preferably the PVA resin has a weighted, average degree of hydrolysis ($\overline{H^{\circ}}$) between about 80 and about 92%, or between about 83 and about 90%, or about 85 and 89%. For example, $\overline{H^{\circ}}$ for a PVA resin that comprises two or more PVA polymers is calculated by the formula $\overline{H^{\circ}}=\Sigma(Wi\cdot H_i)$ where $W_1$ is the weight percentage of the respective PVA polymer and a $H_i$ is the respective degrees of hydrolysis. Still further it is desirable to choose a PVA resin that has a weighted log viscosity ($\overline{\mu}$) between about 10 and about 25, or between about 12 and 22, or between about 13.5 and about 20 . The $\overline{\mu}$ for a PVA resin that comprises two or more PVA polymers is calculated by the formula $\overline{\mu}=e^{\Sigma W_i \cdot ln\ \mu_i}$ where is $\mu_i$ the viscosity for the respective PVA polymers.

Yet further, it is desirable to choose a PVA resin that has a Resin Selection Index (RSI) in a range of 0.255 to 0.315, or 0.260 to 0.310, or 0.265 to 0.305, or 0.270 to 0.300, or 0.275 to 0.295, preferably 0.270 to 0.300. The RSI is calculated by the formula; $\Sigma(W_i|\mu_i-\mu_i|)/\Sigma(W_i\mu_i)$, wherein $\mu_i$ is seventeen, $\mu_i$ is the average viscosity each of the respective PVOH polymers, and $W_i$ is the weight percentage of the respective PVOH polymers.

Even more preferred films are water soluble copolymer films comprising a least one negatively modified monomer with the following formula:

$$[Y]\text{-}[G]_n$$

wherein Y represents a vinyl alcohol monomer and G represents a monomer comprising an anionic group and the index n is an integer of from 1 to 3 . G can be any suitable comonomer capable of carrying of carrying the anionic group, more preferably G is a carboxylic acid. G is preferably selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

The anionic group of G is preferably selected from the group consisting of $OSO_3M$, $SO_3M$, $CO_2M$, $OCO_2M$, $OPO_3M_2$, $OPO_3HM$ and $OPO_2M$. More preferably anionic group of G is selected from the group consisting of $OSO_3M$, $SO_3M$, $CO_2M$, and $OCO_2M$. Most preferably the anionic group of G is selected from the group consisting of $SO_3M$ and $CO_2M$.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including water, to be delivered to the wash water, for example organic polymeric dispersants, etc.

The water-soluble pouch may be comprised of just one water-soluble film, or may comprise two, or even three, or even four water-soluble films. The water-soluble pouch may be formed by moulding a first film to form an open cavity, filling said open cavity with a composition and then sealing shut the open cavity with a second film. The second film may be sealed to the first film using any suitable means, including but not limited to heat sealing or solvent sealing or a mixture thereof. The second film may comprise another sealed compartment, or even two sealed compartments made in substantially the same way as described above. In this instance, the water-soluble pouch comprises three films. Means of manufacture is preferably via a continuous forming process using either horizontal and rotating forming means, or a combination thereof. Those skilled in the art will be aware of suitable forming means.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Composition

The composition of the present disclosure may be a fully formulated product, such as a laundry composition. Alternatively, it may be a composition that is added to other components in order to make a fully formulated product.

The composition may be a laundry composition, automatic dishwashing composition, hard surface cleaner composition or a mixture thereof. Preferably, the composition is a laundry composition, even a laundry treatment composition, even a laundry detergent composition.

The composition when dissolved in 9 parts of water (where the composition is 1 part) gives a pH between 4 and 11, or even between 5 and 10, or even between 6 and 9, or even between 6.5 to 8.5.

The composition may be a liquid or a granular or solid composition.

Liquids include liquids, gels, pastes, dispersions and the like.

The composition may be a granular laundry detergent composition. The granules may be spray-dried, agglomerated or extruded for example.

Suitable compositions include, but are not limited to, consumer products such as: products for treating fabrics, hard surfaces and any other surfaces in the area of fabric and home care, including: dishwashing, laundry cleaning, laundry and rinse additives, and hard surface cleaning including floor and toilet bowl cleaners.

A particularly preferred embodiment of the disclosure is a "liquid laundry treatment composition". As used herein, "liquid laundry treatment composition" refers to any laundry treatment composition comprising a liquid capable of wetting and treating fabric e.g., cleaning clothing in a domestic washing machine. The liquid composition can include solids or gases in suitably subdivided form, but the liquid composition excludes forms which are non-fluid overall, such as tablets or granules. A liquid composition includes liquids, gels, pastes, dispersions and the like. The liquid compositions preferably have densities in the range from of 0.9 to 1.3 grams per cubic centimeter, more preferably from 1.00 to 1.1 grams per cubic centimeter, excluding any solid additives, but including any bubbles, if present.

The composition comprises an anionic surfactant present at a concentration of greater than 5% by weight of the composition. The anionic surfactant is described in more detail below.

The composition comprises a non-ionic surfactant present at a concentration of 4% or less by weight of the composition. The non-ionic surfactant is described in more detail below.

The composition optionally comprises a fatty acid. If present, the fatty acid is at a concentration of 4% or less by weight of the composition. The fatty acid is described in more detail below.

The composition comprises a siloxane-based polymer suds suppressor. The suds suppressor is described in more detail below.

Preferably, the ratio of anionic surfactant to suds suppressor is from 2.5:1 to 100:1.

Preferably, the ratio of anionic surfactant to non-ionic surfactant is from 1:1 to 6000:1.

Anionic Surfactant

The composition comprises an anionic surfactant present at a concentration of greater than 5% by weight of the composition. The anionic surfactant may be present at a concentration of between 15% and 40%, or even between 30% and 40%, or even between 35% and 40% by weight of the composition.

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383 . Especially useful are the sodium, potassium and amine linear straight chain alkylbenzene sulfonates in which the average number of carbon atoms in the alkyl group is from about 11 to 14 . Sodium $C_{11}$-$C_{14}$, e.g., $C_{12}$, LAS is a specific example of such surfactants.

Specific, non-limiting examples of anionic surfactants useful herein include the acid or salt forms of: a) $C_{11}$-$C_{18}$ alkyl benzene sulfonates (LAS); b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates with non-limiting examples of suitable cations including sodium, potassium, ammonium, amine and mixtures thereof; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

A suitable anionic detersive surfactant is predominantly alkyl $C_{16}$ alkyl mid-chain branched sulphate. A suitable feedstock for predominantly alkyl $C_{16}$ alkyl mid-chain branched sulphate is beta-farnesene, such as BioFene™ supplied by Amyris, Emeryville, California.

Non-ionic Surfactant

The composition comprises a non-ionic surfactant present at a concentration of 4% or less by weight of the composition. The non-ionic surfactant may be present at a concentration of between 0.01% and 4%, or even between 0.01% and 3%, or even between 1% and 2% by weight of the composition. Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein optionally the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, such as alkylpolyglycosides; polyhydroxy fatty acid amides; ether capped poly(oxyalkylated) alcohol surfactants; and mixtures thereof.

Suitable non-ionic detersive surfactants are alkyl polyglucoside and/or an alkyl alkoxylated alcohol.

Suitable non-ionic detersive surfactants include alkyl alkoxylated alcohols, such as $C_{8-18}$ alkyl alkoxylated alcohol, or a $C_{8-18}$ alkyl ethoxylated alcohol. The alkyl alkoxylated alcohol may have an average degree of alkoxylation of from 0.5 to 50, or from 1 to 30, or from 1 to 20, or from 1 to 10 . The alkyl alkoxylated alcohol may be a $C_{8-18}$ alkyl ethoxylated alcohol, typically having an average degree of ethoxylation of from 1 to 10, or from 1 to 7, or from 1 to 5, or from 3 to 7 . The alkyl alkoxylated alcohol can be linear or branched, and substituted or un-substituted.

Suitable nonionic detersive surfactants include secondary alcohol-based detersive surfactants having the formula:

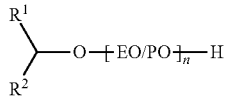

wherein $R^1$=linear or branched, substituted or unsubstituted, saturated or unsaturated $C_{2-8}$ alkyl;

wherein $R^2$=linear or branched, substituted or unsubstituted, saturated or unsaturated $C_{2-8}$ alkyl, wherein the total number of carbon atoms present in $R^1$+$R^2$ moieties is in the range of from 7 to 13;

wherein EO/PO are alkoxy moieties selected from ethoxy, propoxy, or mixtures thereof, optionally the EO/PO alkoxyl moieties are in random or block configuration;

wherein n is the average degree of alkoxylation and is in the range of from 4 to 10.

Other suitable non-ionic detersive surfactants include EO/PO block co-polymer surfactants, such as the Plurafac® series of surfactants available from BASF, and sugar-derived surfactants such as alkyl N-methyl glucose amide.

Siloxane-based Polymer Suds Suppressor

The composition comprises a siloxane-based polymer suds suppressor (herein also referred to simply as 'suds suppressor').

The compositions may comprise between 0.001% and 4.0%, or even between 0.01% and 2%, preferably between 0.02% and 1% by weight of the composition of a siloxane-based polymer suds suppressor.

The suds suppressor may be an organomodified siloxane polymer.

The organomodified siloxane polymers may comprise aryl or alkylaryl substituents optionally combined with silicone resin and/or modified silica;

In one embodiment, the suds suppressor is selected from organomodified silicone polymers with aryl or alkylaryl substituents combined with silicone resin and optionally a primary filler.

Particularly preferred are silicone suds suppressor compounds consisting of organomodified silicone polymers with aryl or alkyaryl substituents combined with silicone resin and modified silica as described in U.S. Pat. Nos. 6,521,586 B1, 6,521,587 B1, US Patent Applications 2005 0239908 A1, 2007 01673 A1 to Dow Corning Corp. and US Patent Application 2008 0021152 A1 to Wacker Chemie AG.

The organomodified silicone polymer with aryl or alkaryl substituents is suitably selected from at least one organosilicon compound which has units of the formula $R_a(R^1O)_b R^2_cSiO_{(4-a-b-c)/2}$ (I) in which each R can be identical or different and is H or a monovalent, SiC-bonded, optionally substituted, aliphatic hydrocarbon radical and comprises at least one aromatic hydrocarbon radical covalently attached to silicon via aliphatic groups. $R^1$ can be identical or different and is H or a monovalent, optionally substituted hydrocarbon radical which is attached to Si via a carbon ring atom, $R^2$ can be identical or different and is a monovalent, optionally substituted, aromatic hydrocarbon radical which is attached to the silicon atom via a carbon ring atom, a is 0, 1, 2 or 3, b is 0, 1, 2 or 3 and c is 0, 1, 2 or 3, with the proviso that the sum a+b+c is less than or equal to 3, and in 1-100%, preferably in 10-60%, more preferably in 20-40% of all units of the formula (I) per molecule, c is other than 0, and in at least 50% of all of the units of the formula (I) in the organosilicon compound the sum a+b+c is 2.

The silicone resin is suitably an organopolysiloxane resin made up of units of the formula $R^3_d(R^4O)_eSiO_{(4-d-e)/2}$(II) in which $R^3$ can be identical or different and is H or a monovalent, optionally substituted, SiC-bonded hydrocarbon radical. $R^4$ can be identical or different and is H or a monovalent, optionally substituted hydrocarbon radical, d is 0, 1, 2 or 3 and e is 0, 1, 2 or 3, with the proviso that the sum d+e≤3 and in less than 50% of all of the units of the formula (II) in the organopolysiloxane resin the sum d+e is 2, The suds suppressor may further optionally comprise an organosilicon compound which has units of the formula $R^5_g(R^6O)_hSiO_{(4-g-h)/2}$(III) in which $R^5$ can be identical or different and has a meaning given for R, $R^6$ can be identical or different and has a meaning given for $R^1$, g is 0, 1, 2 or 3 and h is 0, 1, 2 or 3, with the proviso that the sum g+h≤3 and in at least 50% of all of the units of the formula (IV) in the organosilicon compound the sum g+h is 2.

In one embodiment, the organomodified silicone polymers having aryl or alkaryl substituents component comprises aromatic radicals attached directly to the silicon atom. In such polymers, there is a covalent bond between a silicon atom in the unit of the formula (I) and a carbon atom belonging to the aromatic ring.

Examples of radicals R are alkyl radicals, such as the methyl, ethyl, n-propyl, isopropyl, n-butyl, isobutyl, tert-butyl, n-pentyl, isopentyl, neopentyl, tert-pentyl radical, hexyl radicals, such as the n-hexyl radical, heptyl radicals, such as the n-heptyl radical, octyl radicals, such as the n-octyl radical and isooctyl radicals, such as the 2,2,4-trimethylpentyl radical, nonyl radicals, such as the n-nonyl radical, decyl radicals, such as the n-decyl radical, dodecyl radicals, such as the n-dodecyl radical; alkenyl radicals, such as the vinyl and the allyl radical; cycloalkyl radicals, such as cyclopentyl, cyclohexyl, cycloheptyl radicals and methylcyclohexyl radicals, and aromatic groups attached via aliphatic groups to the silicon atom, such as the benzyl radical, phenylethyl radical or the 2-phenylpropyl radical.

Examples of substituted radicals R are 3,3,3-trifluoro-n-propyl radical, cyanoethyl, glycidyloxy-n-propyl, polyalkylene glycol-n-propyl, amino-n-propyl, aminoethylamino-n-propyl, and methacryloyloxy-n-propyl radicals.

Preferably radical R comprises hydrogen atom or optionally substituted, aliphatic hydrocarbon radicals having 1 to 30 carbon atoms, more preferably aliphatic hydrocarbon radicals having 1 to 4 carbon atoms, and in particular the methyl radical.

Examples of radical $R^1$ are hydrogen atom and the radicals indicated for radical R and $R^2$.

Preferably radical $R^1$ comprises hydrogen atom or optionally substituted hydrocarbon radicals having 1 to 30 carbon atoms, more preferably hydrogen atom or hydrocarbon radicals having 1 to 4 carbon atoms, especially methyl or ethyl radicals.

Examples of $R^2$ are aryl radicals, such as phenyl, toloyl, xylyl, cumyl, naphthyl and anthracyl radicals.

Radical $R^2$ is preferably the phenyl radical.

Radical $R^2$ is preferably 10 to 100%, more preferably 15 to 50%, of the SiC-bonded radicals in component (i). Preferably b is 0 or 1, more preferably 0 . Preferably c is 0, 1 or 2.

Preferably, less than 5%, especially less than 1%, of the radicals R are hydrogen atom.

The organosilicon compounds are preferably branched or linear organopolysiloxanes. In the context of the present disclosure the term "organopolysiloxanes" is intended to embrace polymeric, oligomeric and dimeric siloxanes.

Examples of the organomodified silicone polymers having aryl or alkaryl substituents of the invention are those comprising units $Ph_3SiO_{1/2}$—, $Ph_2MeSiO_{1/2}$—, $PhMe_2SiO_{1/2}$—, $Ph_2SiO_{2/2}$—, $PhMeSiO_{2/2}$— and $PhSiO_{3/2}$—, where Me denotes methyl radical and Ph denotes phenyl radical, such as, for example, linear polysiloxanes of the formulae $Me_3SiO(Ph_2SiO)_x(Me_2SiO)_xSiMe_3$, $Me_3SiO(PhMeSiO)_y(Me_2SiO)_zSiMe_3$, $Me_3SiO(Ph_2SiO)_x(PhMeSiO)_y(Me_2SiO)_zSiMe_3$, and $Me_3SiO(Ph_2SiO)_x(Me_2SiO)_zSiMe_3$, and also branched polysiloxanes of the formulae $MeSi[O(Ph_2SiO)_x(Me_2SiO)_zSiMe_3]_3$, $PhSi[O(PhMeSiO)_y(Me_2SiO)_zSiMe_3]_3$, and $Me_3SiO(Me_2SiO)_z[PhSiO(OMe_2SiO)_zSiMe_3]_v(Me_2SiO)_zSiMe_3$, the coefficients v, x, and y independently of one another adopting values greater than or equal to 1, and z being 0 or greater than or equal to 1 . The sum of v, x, y, and z determines the degree of polymerization, v the number of branches, and hence the viscosity.

The organomodified silicone polymers having aryl or alkaryl substituents of the invention have a viscosity of preferably 10 to 1 000 000 mPas, more preferably from 100 to 50 000 mPas, in particular from 500 to 5 000 mPas, measured in each case at 25° C.

The organomodified silicone polymers having aryl or alkaryl substituents of the invention are commercially available products or can be prepared by any methods known to date in organosilicon chemistry, such as, for example, by cohydrolysis of the corresponding silanes.

The suds suppressors used in the invention may comprise primary filler, preferably a modified silica, in amounts of preferably 0.1 to 30 parts by weight, more preferably 1 to 15 parts by weight, based in each case on 100 parts by weight.

Primary fillers employed in accordance with the invention may comprise exclusively pulverulent fillers, more preferably pulverulent hydrophobic fillers.

Preferably the primary filler component has a BET surface area of 20 to 1000 $m^2/g$, a particle size of less than 10 μm and an agglomerate size of less than 100 μm.

Examples of primary fillers are silicon dioxide (silicas), titanium dioxide, aluminum oxide, metal soaps, quartz flour, PTFE powders, fatty acid amides, ethylenebisstearamide for example, and finely divided hydrophobic polyurethanes.

As primary filler component it is preferred to use silicon dioxide (silicas), titanium dioxide or aluminum oxide having a BET surface area of 20 to 1000 $m^2/g$, a particle size of less than 10 μm and an agglomerate size of less than 100 μm.

Of particular preference as primary filler component are silicas, particularly those having a BET surface area of 50 to 800 $m^2/g$. These silicas may be pyrogenic or precipitated silicas+.

As primary filler it is possible to use both pretreated silicas, i.e., commercially customary hydrophobic silicas, and hydrophilic silicas.

Examples of hydrophobic silicas which can be used in accordance with the invention are HDK® H2000, a pyrogenic, hexamethyldisilazane-treated silica having a BET surface area of 140 $m^2/g$ (available commercially from Wacker-Chemie GmbH, Germany) and a precipitated, polydimethylsiloxane-treated silica having a BET surface area of 90 $m^2/g$ (available commercially under the name "Sipernat® D10" from Degussa AG, Germany).

If hydrophobic silicas are to be used as primary filler component, it is also possible to hydrophobicize hydrophilic silicas in situ, if to do so is advantageous for the desired effectiveness of the anti-foams. There are many known methods of hydrophobicizing silicas. The hydrophilic silica can be hydrophobicized in situ by, for example, heating the silica in dispersion or in a mixture of organomodified silicone polymers having aryl or alkaryl substituents with silicone resins at temperatures of 100 to 200° C. for a number of hours. This reaction can be assisted by the addition of catalysts, such as KOH, and of hydrophobicizers, such as short-chain OH-terminated polydimethylsiloxanes, silanes or silazanes. This treatment is also possible when using commercially customary hydrophobic silicas, and may contribute to improved effectiveness.

Another possibility is to use a combination of silicas hydrophobicized in situ with commercially customary hydrophobic silicas.

Examples of radical $R^3$ are hydrogen atom and the radicals indicated for radical R and $R^2$. Preferably $R^3$ comprises optionally substituted hydrocarbon radicals having 1 to 30 carbon atoms, more preferably hydrocarbon radicals having 1 to 6 carbon atoms, and in particular the methyl radical.

Examples of radical $R^4$ are the radicals indicated for the radical $R^1$.

Radical $R^4$ preferably comprises hydrogen atom or hydrocarbon radicals having 1 to 4 carbon atoms, particularly hydrogen atom, methyl radicals or ethyl radicals.

Preferably the value of d is 3 or 0.

The resin component used in accordance with the invention preferably comprises silicone resins made up of units of the formula (II) for which in less than 30%, preferably in less than 5%, of the units in the resin the sum d+e is 2.

With particular preference the silicone resin component comprises organopolysiloxane resins composed essentially of $R^3{}_3SiO_{1/2}$ (M) and $SiO_{4/2}$ (Q) units with $R^3$ the same as the abovementioned definition; these resins are also called MQ resins. The molar ratio of M to Q units is preferably in the range from 0.5 to 2.0, more preferably in the range from 0.6 to 1.0. These silicone resins may additionally contain up to 10% by weight of free hydroxyl or alkoxy groups.

Preferably the resin component has a viscosity at 25° C. of more than 1000 mPas or are solids. The weight-average molecular weight determined by gel permeation chromatography (relative to a polystyrene standard) of these resins is preferably 200 to 200 000 g/mol, in particular 1000 to 20 000 g/mol.

The resin component comprises commercially customary products or can be prepared by methods that are commonplace in silicon chemistry, in accordance for example with EP-A 927 733.

The suds suppressor moreover includes embodiments comprising both the primary filler (preferably a modified silica) and a resin at a weight ratio in the order recited, of from 0.01 to 50, more preferably 0.1 to 7.

Examples of radicals $R^5$ are the examples indicated for radical R.

Preferably radical $R^5$ comprises hydrogen atom or optionally substituted, aliphatic hydrocarbon radicals having 1 to 30 carbon atoms, more preferably aliphatic hydrocarbon radicals having 1 to 4 carbon atoms, and especially the methyl radical.

Examples of radical $R^6$ are hydrogen atom and the radicals indicated for radical R and $R^2$.

Preferably radical $R^6$ comprises hydrogen atom or optionally substituted hydrocarbon radicals having 1 to 30 carbon atoms, more preferably hydrogen atom or hydrocarbon radicals having 1 to 4 carbon atoms, and especially methyl radicals or ethyl radicals.

The value of g is preferably 1, 2 or 3 . The value of h is preferably 0 or 1.

In addition, the suds suppressors may comprise a further substance such as have also been used to date in defoamer formulations, such as, for example, water-insoluble organic compounds.

The term "water-insoluble" is intended to be understood for the purposes of the present disclosure as meaning a solubility in water at 25° C. under a pressure of 1013.25 hPa of not more than 2 percent by weight.

Water-insoluble organic compounds, used optionally, preferably comprises water-insoluble organic compounds having a boiling point greater than 100° C. under the pressure of the surrounding atmosphere, i.e., under 900 to 1100 hPa, and particularly compounds selected from mineral oils, natural oils, isoparaffins, polyisobutylenes, residues from the synthesis of alcohols by the oxo process, esters of low molecular mass synthetic carboxylic acids, fatty acid esters, such as octyl stearate and dodecyl palmitate, for example, fatty alcohols, ethers of low molecular mass alcohols, phthalates, esters of phosphoric acid, and waxes.

The components used in the invention may in each case comprise one kind of one such component or else a mixture of at least two kinds of each individual component.

The suds suppressors used in the present invention are preferably viscous, clear to opaque, colorless to brownish liquids. The suds suppressors used in the present invention preferably have a viscosity of 10 to 2,000,000 mPas, in particular of 2,000 to 50,000 mPas, in each case at 25° C.

Suds suppressors useful herein include those silicone suds suppressors described in U.S. Pat. Nos. 6,251,586 and 6,251,587, both to Dow Corning. Such anti-foams comprise (A) an organopolysiloxane material having at least one silicon-bonded substituent of the formula X-Ph, wherein X denotes a divalent aliphatic organic group bonded to silicon through a carbon atom and Ph denotes an aromatic group, (B) an organosilicon resin and (C) a hydrophobic filler. The aromatic group can be unsubstituted or substituted.

The organopolysiloxane material (A) is preferably a fluid and is preferably a polydiorganosiloxane. The polydiorganosiloxane (A) preferably comprises diorganosiloxane units of the formula

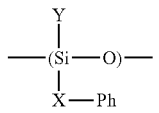

where Y is an alkyl group having 1 to 4 carbon atoms, preferably methyl. These diorganosiloxane units containing a -X-Ph group may comprise substantially all or a majority of the diorganosiloxane units in organopolysiloxane (A), but preferably comprise up to 50 or 60%, most preferably 5 to 40%, of the diorganosiloxane units in (A). The group X is preferably a divalent alkylene group having from 2 to 10 carbon atoms, most preferably 2 to 4 carbon atoms, but can alternatively contain an ether linkage between two alkylene groups or between an alkylene group and -Ph, or can contain an ester linkage. Ph is preferably a moiety containing at least one aromatic ring $—C_6R_5$, wherein each R independently denotes hydrogen, halogen, hydroxyl, an alkoxy group having 1 to 6 carbon atoms or a monovalent hydrocarbon group having 1 to 12 carbon atoms, or wherein two or more R groups together represent a divalent hydrocarbon group. Ph is most preferably a phenyl group, but may be substituted for example by one or more methyl, methoxy, hydroxyl or chloro group, or two substituents R may together form a divalent alkylene group, or may together form an aromatic ring, resulting in conjunction with the Ph group in e.g. a naphthalene group. A particularly preferred X-Ph group is 2-phenylpropyl —$CH_2$—$CH(CH_{3)-C6}H_5$. Alternatively Ph can be a heterocyclic group of aromatic character such as thiophene, pyridine or quinoxaline.

The polydiorganosiloxane (A) also preferably comprises at least 50% diorganosiloxane units of the formula

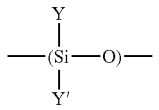

where Y' is a hydrocarbon group having 1 to 24 carbon atoms, preferably an aliphatic group of up to 6 carbon atoms, for example ethyl, propyl, isobutyl, methyl, hexyl or vinyl, or lauryl or a cycloalkyl group such as cyclohexylethyl. Mixtures of alkyl groups Y' can be used. It is believed that the enhanced foam control of the anti-foam agents of the invention may involve interaction between the Ph groups of (A) and the organosilicon resin (B), and the Ph groups may be more accessible if no long chain alkyl groups are present. Other groups can be present as Y', for example haloalkyl groups such as chloropropyl or acyloxyalkyl or alkoxyalkyl groups. At least some of the groups Y' can be phenyl groups or substituted phenyl groups such as tolyl; aromatic groups bonded direct to silicon are not equivalent to the groups -X-Ph but can be present as Y'.

The organopolysiloxane material (A) may be made by any suitable method, but preferably is made by hydrosilylation reaction between a siloxane polymer having a number of silicon-bonded hydrogen atoms with the appropriate amount of X"-Ph molecules, wherein X" is as described for X, but has aliphatic unsaturation in the terminal group, allowing addition reaction with the silicon-bonded hydrogen atoms of the siloxane polymer. Examples of suitable X"-Ph materials include styrene (which introduces 2-phenylethyl groups), α-methyl styrene, eugenol, allylbenzene, allyl phenyl ether, 2-allylphenol, 2-chlorostyrene, 4-chlorostyrene, 4-methylstyrene, 3-methylstyrene, 4-t-butylstyrene, 2,4- or 2,5-dimethylstyrene or 2,4,6-trimethylstyrene, α-methyl styrene introduces 2-phenylpropyl groups, which are believed to be mainly 2-phenyl-1-propyl groups but may include 2-phenyl-2-propyl groups. Mixtures of X"-Ph materials can be used, for example styrene with α-methyl styrene. Such hydrosilylation reaction is preferably carried out under conditions and in the presence of suitable catalysts as described, for example, in U.S. Pat. No. 4,741,861 . A radical inhibitor is preferably present to prevent homopolymerisation of X"-Ph.

The organopolysiloxane material (A) may be a substantially linear polydiorganosiloxane or may have some branching. The branching may be in the siloxane chain, brought about e.g. by the presence of some tri-functional siloxane units of the formula $ZSiO_3/2$, where Z denotes a hydrocarbon, hydroxyl or hydrocarbonoxy group. Alternatively branching may be caused by a multivalent, e.g. divalent or trivalent, organic or silicon-organic moiety linking siloxane polymer chains. The organic moiety can be a divalent linking group of the formula -X'-, and the silicon-organic moiety can be a divalent linking group of the formula X'-Sx-X', where X' denotes a divalent organic group bonded to silicon through a carbon atom and Sx is an organosiloxane group. Examples of organic linking (branching) units are $C_{2-6}$ alkylene groups, e.g. dimethylene or hexylene, or aralkylene groups of the formula -X'-Ar-X'-, where Ar denotes phenylene. Hexylene units can be introduced by reaction of 1,5-hexadiene with Si—H groups and -X'-Ar-X'- units by reaction of divinylbenzene or diisopropylbenzene. Examples of silicon-organic linking units are those of the formula —$(CH_{2)d}$—$(Si(CH_{3)2}$—$O)_e$—Si(CH3)2-$(CH_{2)d}$— wherein d has a value of from 2 to 6 and e has a value of from 1 to 10; for example linking units of the latter formula with d=2 and e=1 can be introduced by reaction of divinyltetramethyldisiloxane with Si—H groups.

After the hydrosilylation reaction with the aromatic compound X"-Ph and any required reaction with a branching agent, the residual Si—H groups of the organopolysiloxane can be reacted with an alkene such as ethylene, propylene, isobutylene or 1-hexene, preferably in the presence of a hydrosilylation catalyst, to introduce the groups Y'.

It is preferred that the number of siloxane units (DP or degree of polymerisation) in the average molecule of material (A) is at least 5, more preferably from 10 to 5,000 . Particularly preferred are materials (A) with a DP of from 20 to 1000, more preferably 20 to 200 . The end groups of the organopolysiloxane (A) can be any of those conventionally present in siloxanes, for example trimethylsilyl end groups.

The organosilicon resin (B) is generally a non-linear siloxane resin and preferably consists of siloxane units of the formula $R'_aSiO_{4-a}/2$ wherein R' denotes a hydroxyl, hydrocarbon or hydrocarbonoxy group and wherein a has an average value of from 0.5 to 2.4 . The resin preferably consists of monovalent trihydrocarbonsiloxy (M) groups of the formula $R''_3$ $SiO_1/2$ and tetrafunctional (Q) groups $SiO_4/2$ wherein R" denotes a monovalent hydrocarbon group. The number ratio of M groups to Q groups is preferably in the range 0.4:1 to 2.5:1 (equivalent to a value of a in the formula $R'_a$ $SiO_{4-a}/2$ of 0.86 to 2.15), and is more preferably 0.4:1 to 1.1:1 and most preferably 0.5:1 to 0.8:1 (equivalent to a=1.0-1.33) for use in laundry detergent applications. The organosilicon resin (B) is preferably a solid at room temperature, but MQ resins having a M/Q ratio of higher than 1.2, which are generally liquid, can be used successfully. Although it is most preferred that the resin (B) consists only of M and Q groups as defined above, a resin comprising M groups, trivalent $R''SiO_3/2$ (T) groups and Q groups can alternatively be used. The organosilicon resin (B) can also contain divalent units $R''_2$ $SiO_2/2$, preferably at no more than 20% of all siloxane units present. The group R" is preferably an alkyl group having from 1 to 6 carbon atoms, most preferably methyl or ethyl, or phenyl. It is particularly preferred that at least 80%, and most preferably substantially all of the R" groups present are methyl groups. Other hydrocarbon groups may also be present, e.g. alkenyl groups present for example as dimethylvinylsilyl units, preferably in small amounts, most preferably not exceeding 5% of all R" groups. Silicon bonded hydroxyl groups and/or alkoxy, e.g. methoxy, groups may also be present.

Such organosilicon resins are well known. They can be made in solvent or in situ, e.g. by hydrolysis of certain silane materials. Particularly preferred is the hydrolysis and condensation in the presence of a solvent, e.g. xylene, of a precursor of the tetravalent siloxy unit (e.g. tetra-orthosilicate, tetraethyl orthosilicate, polyethyl silicate or sodium silicate) and a precursor of mono-valent trialkylsiloxy units (e.g. trimethylchlorosilane, trimethylethoxysilane, hexamethyldisiloxane or hexamethyldisilazane). The resulting MQ resin can if desired be further trimethylsilylated to react out residual Si—OH groups or can be heated in the presence of a base to cause self-condensation of the resin by elimination of Si—OH groups.

The organosilicon resin (B) is preferably present in the anti-foam at 1-50% by weight based on organopolysiloxane (A), particularly 2-30% and most preferably 4-15%.

The organosilicon resin (B) may be soluble or insoluble (not wholly dissolved) in the organopolysiloxane (A) when present in the above amounts. Solubility can be measured by observing a mixture of (A) and (B) in an optical microscope. Enhanced foam control in detergent applications has been achieved both by compositions containing dissolved organosilicon resin (B) and by compositions containing dispersed particles of organosilicon resin (B). The factors affecting solubility of (B) in (A) include the proportion of X-Ph groups in (A) (more X-Ph groups increase solubility), the degree of branching in (A), the nature of the groups Y and Y' in (A) (long chain alkyl groups decrease solubility), the ratio of M to Q units in MQ resin (B) (higher ratio of M groups to Q groups increases solubility) and the molecular weight of (B). The solubility of (B) in (A) at ambient temperature can thus be from 0.01% by weight or less up to 15% or more. It may be advantageous to use a mixture of a soluble resin (B) and an insoluble resin (B), for example a mixture of MQ resins having different M/Q ratios. If the organosilicon resin (B) is insoluble in organopolysiloxane (A), the average particle size of resin (B), as measured when dispersed in liquid (A), may for example be from 0.5 to 400 μm, preferably 2 to 50 μm. For industrial foam control applications such as defoaming of black liquor in the paper and pulp industry, resins which are soluble in the siloxane copolymer, such as MQ resins having a high M/Q ratio, are usually preferred.

The resin (B) can be added into the anti-foam as a solution in a non-volatile solvent, for example an alcohol such as dodecanol or 2-butyl-octanol or an ester such as octyl stearate. The resin solution prepared in a volatile solvent, eg xylene, can be united with the non-volatile solvent and the volatile solvent may be removed by stripping or by other forms of separation. In most cases the non-volatile solvent can be left in the anti-foam. It is preferred that the resin (B) is dissolved in an equal amount of non-volatile solvent or less, more preferably no more than about half its weight of solvent. The resin (B) can alternatively be added in solution in a volatile solvent followed stripping off the solvent. If the resin (B) is added as a solution and is insoluble in organopolysiloxane material (A), it will form solid particles with an acceptable particle size on mixing.

The resin (B) can alternatively be added into the anti-foam in the form of solid particles, for example spray dried particles. Spray dried MQ resins are available commercially, for example of average particle size 10 to 200 microns.

The level of insolubility of resin (B) in organopolysiloxane material (A) may affect its particle size in the composition. The lower the solubility of the organosilicon resins in organopolysiloxane material (A), the larger the particle size tends to be when the resin is mixed as a solution into (A). Thus an organosilicon resin which is soluble at 1% by weight in organopolysiloxane material (A) will tend to form smaller particles than a resin which is only soluble at 0.01% by weight. Organosilicon resins (B) which are partly soluble in organopolysiloxane material (A), that is having a solubility of at least 0.1% by weight, are preferred.

The molecular weight of the resin (B) can be increased by condensation, for example by heating in the presence of a base. The base can for example be an aqueous or alcoholic solution of potassium hydroxide or sodium hydroxide, e.g. a solution in methanol or propanol. We have found that for some detergents, anti-foams containing the lower molecular weight MQ resins are the most effective at reducing foam but those containing MQ resins of increased molecular weight are more consistent in giving the same reduced foam levels under different conditions, for example at different wash temperatures or in different washing machines. The MQ resins of increased molecular weight also have improved resistance to loss of performance over time when stored in contact with the detergent, for example as an emulsion in liquid detergent. The reaction between resin and base may be carried out in the presence of the silica, in which case there may be some reaction between the resin and the silica. The reaction with base can be carried out in the presence of the organopolysiloxane (A) and/or in the presence of the non-volatile solvent and/or in the presence of a volatile solvent. The reaction with base may hydrolyse an ester non-volatile solvent such as octyl stearate but we have found that this does not detract from the foam control performance.

The third essential ingredient is a hydrophobic filler (C). Hydrophobic fillers for anti-foams are well known and may be such materials as silica, preferably with a surface area as measured by BET measurement of at least 50 $m^2/g$, titania, ground quartz, alumina, aluminosilicates, organic waxes e.g. polyethylene waxes and microcrystalline waxes, zinc oxide, magnesium oxide, salts of aliphatic carboxylic acids, reaction products of isocyanates with certain materials, e.g. cyclohexylamine, or alkyl amides, e.g. ethylenebisstearamide or methylenebisstearamide. Mixtures of one or more of these are also acceptable.

Some of the fillers mentioned above are not hydrophobic in nature, but can be used if made hydrophobic. This could be done either in situ (i.e. when dispersed in the organopolysiloxane material (A)), or by pre-treatment of the filler prior to mixing with material (A). A preferred filler is silica which is made hydrophobic. This can be done e.g. by treatment with a fatty acid, but is preferably done by the use of methyl substituted organo-silicon materials. Suitable hydrophobing agents include polydimethylsiloxanes, dimethylsiloxane polymers which are end-blocked with silanol or silicon-bonded alkoxy groups, hexamethyldisilazane, hexamethyldisiloxane and organosilicon resins comprising monovalent groups $(CH_3)_3SiO_1/2$ and tetravalent groups $SiO_2$ in a ratio of from 0.5/1 to 1.1/1 (MQ resins). Hydrophobing is generally carried out at a temperature of at least 80° C. Similar MQ resins can be used as the organosilicon resin (B) and as the hydrophobing agent for silica filler (C).

Preferred silica materials are those which are prepared by heating, e.g. fumed silica, or by precipitation, although other types of silica such as those made by gel-formation are also acceptable. The silica filler may for example have an average particle size of from 0.5 to 50 microns, preferably 2 to 30 μm, most preferably from 5 to 25 μm. Such materials are well known and are commercially available, both in hydrophilic form and in hydrophobic form.

The amount of filler (C) in the anti-foam is preferably 0.5 to 50% by weight based on organopolysiloxane material (A), particularly from 1 up to 10% or 15% and most preferably 2-8%. It is also preferred that the ratio of the weight of resin (B) to the weight of filler (C) is from 1/10 to 20/1, preferably 1/5 to 10/1 most preferably 1/2 to 6/1.

The suds suppressors may be made in any convenient way, but preferably are provided by mixing the different ingredients under shear. The amount of shear is preferably sufficient to provide good dispersion of components (B) and (C) in material (A), but not so much that the particles (B) and/or (C) would be broken, thus possibly making them less effective, or re-exposing surfaces which are not hydrophobic. Where the filler (C) needs to be made hydrophobic in situ, the manufacturing process would include a heating stage, preferably under reduced pressure, in which the filler and the treating agent are mixed together in part or all of organopolysiloxane material (A), possibly in the presence of a suitable catalyst, where required.

The suds suppressors according to the present invention may be provided as a simple mixture of (A), (B) and (C), but for some applications it may be preferred to make them available in alternative forms. For example for use in aqueous media, it maybe appropriate to provide the anti-foam in an emulsion form, preferably an oil/in/water emulsion.

Methods of providing silicone-based anti-foams in oil-in-water emulsion form are known and have been described in a number of publications and patent specifications. Examples are EP 913,187, EP 0879628, WO 98-22,196, WO 98-00216, GB 2,315,757, EP 499364, and EP 459,512 . Emulsions may be made according to any of the known techniques, and may be macro-emulsions or micro-emulsions. In general, they comprise the anti-foam as the oil phase, one or more surfactants, water and standard additives, such as preservatives, viscosity modifiers, protective colloids and/or thickeners. The surfactants may be selected from anionic, cationic, nonionic or amphoteric materials. Mixtures of one or more of these may also be used. Suitable anionic organic surfactants include alkali metal soaps of higher fatty acids, alkyl aryl sulphonates, for example sodium dodecyl benzene sulphonate, long chain (fatty) alcohol sulphates, olefin sulphates and sulphonates, sulphated monoglycerides, sulphated esters, sulphonated ethoxylated alcohols, sulphosuccinates, alkane sulphonates, phosphate esters, alkyl isethionates, alkyl taurates and/or alkyl sarcosinates. Suitable cationic organic surfactants include alkylamine salts, quaternary ammonium salts, sulphonium salts and phosphonium salts. Suitable nonionic surfactants include silicones such as those described as Surfactants 1-6 in EP 638346, particularly siloxane polyoxyalkylene copolymers, condensates of ethylene oxide with a long chain (fatty) alochol or (fatty) acid, for example $C_{14-15}$ alcohol, condensed with 7 moles of ethylene oxide (Dobanol® 45-7), condensates of ethylene oxide with an amine or an amide, condensation products of ethylene and propylene oxides, esters of glycerol, sucrose or sorbitol, fatty acid alkylol amides, sucrose esters, fluoro-surfactants and fatty amine oxides. Suitable amphoteric organic detergent surfactants include imidazoline compounds, alkylaminoacid salts and betaines. It is more preferred that the organic surfactants are nonionic or anionic materials. Of particular interest are surfactants which are environmentally acceptable. The concentration of anti-foam in an emulsion may vary according to applications, required viscosity, effectiveness of the anti-foam and addition system, and ranges on average from 5 to 80% by weight, preferably 10 to 40%. A foam control emulsion may also contain a stabilising agent such as a silicone glycol copolymer or a crosslinked organopolysiloxane polymer having at least one polyoxyalkylene group, as described in EP663225.

Alternatively the suds suppressor can be provided as a water-dispersible composition in which (A), (B) and (C) are dispersed in a water-dispersible carrier such as a silicone glycol or in another water-miscible liquid such as ethylene glycol, propylene glycol, polypropylene glycol, polyethylene glycol, a copolymer of ethylene and propylene glycols, a condensate of a polyalkylene glycol with a polyol, an alkyl polyglycoside, an alcohol alkoxylate or an alkylphenol alkoxylate or in a mineral oil as described in U.S. Pat. No. 5,908,891.

Fatty Acid

The composition may comprise a fatty acid. If present, the fatty acid is at a concentration of 4% or less by weight of the composition. Fatty acid may be present at between 0.001% and 4%, or even 0.1% and 3% or even 1% and 2% by weight of the composition.

Examples of fatty acids useful herein are selected from the group consisting of lauric acid, tridecylic acid, myristic acid, pentadecylic acid, palmitic acid, margaric acid, stearic acid, arachidic acid, phytanic acid, behenic acid, palmitoleic acid, oleic acid, elaidic acid, vaccenic acid, linoleic acid, cis-eleostearic acid, trans-eleosteric acid, linolenic acid, arachidonic acid and combinations thereof. Fatty acids can be saturated or unsaturated. Unsaturated fatty acids typically having an iodine value from 15 to 25, preferably from 18 to 22 and a cis:trans isomer ratio from 1:1 to 200:1, preferably from 10:1 to 200:1.

Preferred sources of fatty acid are selected from the group consisting of coconut, soybean, tallow, palm, palm kernel, rapeseed, lard, sunflower, corn, safflower, canola, olive, peanut and combinations thereof.

The fatty acid may be present in the neutralized form, e.g. as a fatty acid carboxylate. Any suitable means of neutralization may be used, including carbonate or amine-based neutralization.

Water

The composition of the present invention comprises less than 20% by weight of the composition of water. The composition may comprise between 0.01% and 20%, or even between 0.1% and 15%, or even between 1% and 12.5% by weight of the composition of water.

Without wishing to be bound by theory, in low water content composition, the formulator will face a number of issues. It is well known to use fatty acid in low water content compositions as a suds suppressor, as the dispersibility of fatty acids in low water is better than high water. Knowing that suds suppressors in low water compositions are the obvious choice, there would be no motivation for the skilled person to use an alternative suds suppressor, i.e. a siloxane-based suds suppressor.

Adjunt Ingredients

The composition may comprise an adjunct ingredient.The adjunct laundry detergent ingredient may be selected from bleach, bleach catalyst, dye, hueing agents, cleaning polymers, alkoxylated polyamines, polyethyleneimines, alkoxylated polyethyleneimines, soil release polymers, amphiphilic graft polymers, surfactants, solvents, dye transfer inhibitors, chelants, enzymes, perfumes, encapsulated perfumes, perfume delivery agents, suds suppressor, brighteners, polycarboxylates, structurants, anti-oxidants, deposition aids and mixtures thereof.

Anti-oxidant: The composition may comprise an anti-oxidant. The antioxidant is preferably selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2, 5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite.

Process of Making

Any suitable process can be used to make the composition of the present invention. Those skilled in the art will know suitable process known the art.

EXAMPLES

The following compositions were prepared.

TABLE 1

| Ingredients (All levels are in weight percent of the composition.) | A | B | C |
|---|---|---|---|
| Linear $C_9$-$C_{15}$ Alkylbenzene sulfonic acid | 22.56 | 22.56 | 22.46 |
| HC24/25 AE2/3S 90/10 blend | 15.36 | 15.36 | 15.29 |
| $C_{12-14}$ alkyl 9-ethoxylate | 3.84 | 3.84 | 3.82 |
| Citric Acid | 1.56 | 1.56 | 1.55 |
| Fatty acid | 4.5 | 4.5 | 6.27 |
| Chelants | 0.62 | 0.62 | 0.62 |
| Cleaning polymers | 5.33 | 5.33 | 5.33 |
| Antifoam AF8017 | — | 0.05 to 0.15 | — |
| Enzymes | 0.12 | 0.12 | 0.12 |
| Brightener 49 | 0.19 | 0.19 | 0.19 |
| Structurant | 0.10 | 0.10 | 0.10 |
| Solvent system* | 18.6 | 17.96 | 17.96 |
| Water | 12.21 | 12.21 | 11.66 |
| Perfume | 1.70 | 1.70 | 1.70 |
| Aesthetics | 1.13 | 1.13 | 1.13 |
| Mono-ethanolamine or NaOH (or mixture thereof) | 9.75 | 9.75 | 9.75 |
| Other laundry adjuncts/minors | bal | bal | bal |

Composition B comprised differing levels of silicone suds suppressor AF8017 which is commercially available from Dow Corning.

Suds (foaming) height during washes comprising these compositions was investigated. Whirlpool Duet High Efficiency front-load washers, on the Normal 40 minute cycle with 2 rinses using 8 gpg water were used. The load used was a clean 8.0-8.5 lb bundle consisting out of 9×100% cotton T-shirts, 6×50/50 poly-cotton blend pillowcases and 6×86/14 poly-cotton blend towels. A clean bundle was used for each treatment and each replicate. Before each tests the machines were rinsed out with soft hot water before starting the test. Machines were cooled down with a short 21° C. rinse cycle to return machines to room temperature. The suds height was recorded every 2 minutes throughout the wash cycle which typically lasts 12 minutes. The suds height was recorded when the rotation of the drum paused. Suds levels were recorded at the start of wash, end of the wash, the first spin, the end of each rinse, and during the final spin. The final spin should be clear of suds and no suds should be visible on the clothes at the end of the cycle. The total cycle time was noted by a separate timer so that this can be compared to the estimated time of 40 minutes. The Whirlpool Duet has a suds detection feature that will send the machine into a function of 'suds lock'. The suds lock will remain for approximately 5 minutes while the machine pulls in cold water and sits idle for the suds to dissipate. A minimum of four replicates was required per product, with washers being rinsed out between cycles. New ballast was used for each replicate. Suds height was measured visually as follows;

TABLE 2

| | |
|---|---|
| 0 | No visible suds |
| 1.0 | Some suds among clothing in wash drum |
| 1.5 | Suds height at bottom rim of washing machine door (visible though the door) |
| 2.0 | Suds height ⅛ of height of the door window |
| 2.5 | Suds height ¼ of height of the door window |
| 3.0 | Suds height ½ of height of the door window |
| 3.5 | Suds height ¾ of height of the door window |
| 4.0 | Suds height fills entire door window |

Success criteria were: maximum suds height of less than 2.5 during the wash at an average cycle time of less than 55 min and with a maximum 1 suds lock out of 4 replicates. Results can be seen in table 3.

TABLE 3

| | C 6.3% Fatty Acid Fresh | A 4.5% Fatty Acid Fresh | B + 0.05% AF8017 Fresh | B + 0.1% AF8017 Fresh | B + 0.15% AF8017 Fresh |
|---|---|---|---|---|---|
| Suds height (<2.5) | yes | yes | yes | yes | yes |
| Av. cycle time <55 min | 51'13" | 61'31" | 50'16" | 45'20" | 46'39" |
| Suds lock (1/4 max) | 0/4 | 3/4 | 0/4 | 0/4 | 0/4 |
| Conclusion | Pass | Fail | Pass | Pass | Pass |

Greasy stain removal performance was assessed via a high throughput screening method to quickly generate multiple replicates (12 in total). The small scale factor of this method allows for the generation of a large number of datapoints in a relatively short amount of time. The principle is basically a stain on a small piece of cotton that is washed inside a small container. The wash liquor was continuously agitated and kept at a controlled temperature (30° C.) and for a specific amount of time (45mins) to replicate specific western European wash conditions. The wash cycle was then followed by 4 rinse cycles. The stain color was measured before and after the wash and as such the Stain Removal Index can be determined In this case the SRI was determined on Burnt Butter (Equest stain) for the products in our example.

TABLE 4

| | EQ Burnt Butter (% SRI) @ 21 gpg |
|---|---|
| Product A | 51.9 |
| Product B | 52.1 |
| Product C | 48.8 |

Product B (according to the present invention) gave comparable suds removal as product C, but better cleaning. Also Product B gave comparable cleaning to Product A, but better suds removal. Therefore, Product B offers both excellent suds removal and cleaning.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-compartment water-soluble pouch comprising a water-soluble film and at least two compartments enclosed by the film, and at least one of the compartments comprises a composition, wherein the composition comprises:

a. an anionic surfactant;

b. a non-ionic surfactant;

c. a fatty acid, wherein the fatty acid is selected from the group consisting of lauric acid, tridecylic acid, myristic acid, pentadecylic acid, palmitic acid, margaric acid, stearic acid, arachidic acid, phytanic acid, behenic acid, palmitoleic acid, oleic acid, elaidic acid, vaccenic acid, linoleic acid, cis-elesotearic acid, trans-elosteric acid, arachidonic acid and combinations thereof;

d. a siloxane-based polymer suds suppressor; and e. from about 0.01% to about 6% by weight of the composition of water;

wherein the anionic surfactant is present at a concentration of between about 35% and about 40% by weight of the composition, the non-ionic surfactant is present at a concentration of about 4% or less by weight of the composition, the suds suppressor is present at a concentration of between about 0.02% and about 1% by weight of the composition, and the fatty acid is present at a concentration of about 4% or less by weight of the composition.

2. The pouch according to claim 1, wherein the non-ionic surfactant is present at a concentration of between about 0.01% and about 4% by weight of the composition.

3. The pouch according to claim 1, wherein the fatty acid is present at a concentration of between about 0.01% and about 4% by weight of the composition.

4. The pouch according to claim 1, wherein the suds suppressor is an organomodified siloxane polymer.

5. The pouch according to claim 1, wherein the anionic surfactant is selected from linear alkyl benzene sulfonate, alkyl ethoxylate sulphate and combinations thereof.

6. The pouch according to claim 1, wherein the composition comprises a structurant.

7. The pouch according to claim 1, wherein the composition comprises at least one adjunct ingredient selected from bleach, bleach catalyst, dye, hueing agents, cleaning polymers, alkoxylated polyamines, polyethyleneimines, alkoxylated polyethyleneimines, soil release polymers, amphiphilic graft polymers, surfactants, solvents, dye transfer inhibitors, chelants, enzymes, perfumes, encapsulated perfumes, perfume delivery agents, suds suppressor, brighteners, polycarboxylates, structurants, anti-oxidants, deposition aids and mixtures thereof.

8. The pouch according to claim 1, wherein the non-ionic surfactant is selected from the group consisting of C8-C18 alkyl ethoxylates; C6-C12 alkyl phenol alkoxylates wherein optionally the alkoxylate units are ethyleneoxy units, propyleneoxy units or a mixture thereof; C12-C18 alcohol and C6-C12 alkyl phenol condensates with ethylene oxide/propylene oxide block polymers; C14-C22 mid-chain branched alcohols, C14-C22 mid-chain branched alkyl alkoxylates having an average degree of alkoxylation of from 1 to 30; alkylpolysaccharides; polyhydroxy fatty acid amides; ether capped poly(oxyalkylated) alcohol surfactants; and mixtures thereof.

* * * * *